US006976463B2

(12) United States Patent
Spath et al.

(10) Patent No.: US 6,976,463 B2
(45) Date of Patent: Dec. 20, 2005

(54) ANTI-ROTATION DEACTIVATION VALVE LIFTER

(75) Inventors: Mark J. Spath, Spencerport, NY (US); Nick J. Hendriksma, Grand Rapids, MI (US); David J. Draeger, Byron, MI (US); William D. Bauman, Dorr, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/023,332

(22) Filed: Dec. 27, 2004

(65) Prior Publication Data

US 2005/0103300 A1 May 19, 2005

Related U.S. Application Data

(63) Continuation of application No. 10/689,215, filed on Oct. 20, 2003.

(51) Int. Cl.[7] ..... F01L 1/14
(52) U.S. Cl. ..... 123/90.59; 123/90.16; 123/90.5
(58) Field of Search ..... 123/90.48, 90.16, 123/90.5, 90.55, 90.59

(56) References Cited

U.S. PATENT DOCUMENTS 4,739,675 A 4/1988 Connell
5,361,733 A 11/1994 Spath et al.
5,398,648 A 3/1995 Spath et al.
5,431,133 A 7/1995 Spath et al.
5,544,628 A 8/1996 Voigt
6,164,255 A 12/2000 Maas et al.
6,196,175 B1 3/2001 Church
6,513,470 B1 2/2003 Hendriksma et al.
2002/0038642 A1 4/2002 Haas et al.

FOREIGN PATENT DOCUMENTS

WO WO 03/067038 A1 8/2003

*Primary Examiner*—Thomas Denion
*Assistant Examiner*—Zelalem Eshete
(74) *Attorney, Agent, or Firm*—Patrick M. Griffin

(57) ABSTRACT

A valve deactivation lifter including means for restricting relative rotation between the pin housing and the lifter body. When used in a V-style or slant engine, a prior art deactivation lifter can be subject to oil drainage during engine shutdown if the oil supply port in the pin housing rests in the "down" position. In an improved lifter, relative rotation between the pin housing and the lifter body is limited and the pin housing is oriented such that the oil supply port is never on the underside of the pin housing. Rotation may be limited by any of several means, for example, a ball disposed in a dimple in the pin housing and extending into a longitudinal groove in the lifter body, and a flat on the pin housing and locking means installed in the lifter body to engage the flat and thus prevent rotation of the pin housing.

12 Claims, 5 Drawing Sheets

ANTI-ROTATION DEACTIVATION VALVE LIFTER

CROSS-REFERENCE TO RELATED APPLICATIONS

This application is a continuation of U.S. application Ser. No. 10/689,215, which was filed on Oct. 20, 2003.

TECHNICAL FIELD

The present invention relates to valve lifters for internal combustion engines; more particularly, to such valve lifters for variably deactivating valves in an internal combustion engine; and most particularly, to a deactivation valve lifter having means for orienting and minimizing rotation of a pin housing within a lifter body to prevent draining of oil from a plunger chamber during periods of engine shutdown.

BACKGROUND OF THE INVENTION

It is well known that overall fuel efficiency in a multiple-cylinder internal combustion engine can be increased by selective deactivation of one or more of the engine valves under certain engine load conditions. A known approach to providing selective deactivation is to equip the hydraulic lifters for those valves with means whereby the lifters may be rendered incapable of transferring the cyclic motion of engine cams into reciprocal motion of the associated push-rods. Typically, a deactivation lifter includes, in addition to the conventional hydraulic lash elimination means, concentric inner and outer portions which are mechanically responsive to the pushrod and to the cam lobe, respectively, and which may be selectively latched and unlatched to each other, typically by the selective engagement of pressurized engine oil.

U.S. Pat. No. U.S. Pat. No. 6,164,255, issued Dec. 26, 2000 to Maas et al., discloses a deactivation hydraulic valve lifter comprising an outer section which encloses an inner section that is axially movable, the outer section having a pot-shaped configuration and a bottom which comprises an end for cam contact and separates the inner section from a cam whereby, upon coupling of the sections by a coupling means, a high lift of a gas exchange valve is effected, and upon uncoupling of the sections, a zero lift. The disclosed coupling means is a single round pin disposed in a transverse bore in the inner section and biased outwards by a coil spring to engage a mating round bore in the outer section, whereby the two sections may be locked together. The bore in the outer section is matable with an oil gallery in the engine block, whereby pressurized oil may be introduced against the head of the locking pin to urge the pin hydraulically into retraction within the inner section to uncouple the inner and outer sections and thereby deactivate the associated engine valve.

U.S. Pat. No. 6,196,175 B1, issued Mar. 6, 2001 to Church et al. discloses a mechanism similar to that disclosed by Maas et al. A single locking pin is selectively extendable from the pin housing into a round locking bore in the lifter body. In addition, an alignment member extends from the pin housing opposite the locking bore through a slot in the lifter body and engages an axially extending slot in the engine block to prevent rotation of the pin housing relative to the lifter body, thus maintaining alignment of the locking pin with the locking bore.

U.S. Pat. No. 6,513,470 B1, issued Feb. 4, 2003 to Hendriksma et al., discloses an improved mechanism useful in a valve deactivating hydraulic lifter. The mechanism includes a pair of opposed locking pins disposed in a transverse bore in the inner section to engage the outer section in two separate locations 180° apart. Further, the outer section single round bore of Maas et al. and Church et al. is replaced by an annular groove formed in the inner wall of the outer section and defining an annular locking surface such that all rotational alignment requirements are removed, the pins being engageable into the groove at all rotational positions of the inner section within the outer section. The groove communicates, similarly to the round bore in Haas et al., with an oil gallery in the engine block for actuation and deactuation of the locking pins. Since the lifter in Hendriksma, et al. uses two locking pins instead of one, as disclosed in Maas, et al. and Church et al, the force applied through the lifter to open the valve is centralized advantageously along the centerline of the lifter thereby improving the smoothness of operation of the locking feature. Further, the pins are flattened in the portion which engages the locking surface to distribute the load over a broad area of the locking surface.

Hendriksma et al. discloses that complete rotational freedom of the pin housing within the lifter body is an advantage in that wear is distributed over time along the entire length of the annular locking surface. However, such total freedom can also be disadvantageous. When the lifter is used in an application such as a V-style or slant engine where the lifter body can be tipped as much as 45° from vertical, the rotational orientation of the pin housing within the lifter body at the time of engine shutdown can be very important. If the oil supply port through the pin housing and the oil supply port in the plunger element are both on the underside of the pin housing when it comes to rest, oil within the plunger element can leak therefrom via tolerances between the pin housing and the lifter body. Then, when the engine is restarted, air is drawn into the high pressure chamber of the lash adjuster causing noisy engine operation for a period of time after the engine is restarted, before the plunger element can be refilled by engine oil. Such noisy operation is obviously highly undesirable and can lead to premature wear of engine components.

It is a principal object of the present invention to provide a deactivation lifter having means for preventing draining of oil from the lifter during periods of engine shutdown.

SUMMARY OF THE INVENTION

Briefly described, a valve deactivation lifter in accordance with the invention includes a clocking mechanism for limiting relative rotation between the pin housing and the lifter body. The lifter body is prevented from rotation within the engine block, as is known in the prior art, to maintain alignment of the roller follower with the cam lobe. For use in a V-style or slant engine installation, the pin housing is oriented, and relative rotation between the pin housing and the lifter body is limited, such that the oil feed port in the pin housing is never on the underside of the pin housing. Thus, oil within the plunger element cannot leak therefrom via the pin housing oil feed port during periods of engine shutdown. Rotation may be limited by any of several means. In a first embodiment, a ball is disposed in a dimple in the outer wall of the pin housing and extends into a longitudinal groove in the inner wall of the lifter body, thus permitting unrestricted relative axial motion during deactivation mode of the lifter but limiting relative rotation. The dimple and ball may be installed at any convenient axial location of the pin housing and lifter body. In a second embodiment, a flat is provided on the pin housing, and an engagement means is installed through a port in the lifter body to engage the flat and thus prevent rotation of the pin housing. Such means may include at least a pin and/or a clip.

BRIEF DESCRIPTION OF THE DRAWINGS

The present invention will now be described, by way of example, with reference to the accompanying drawings, in which.

DESCRIPTION OF THE PREFERRED EMBODIMENTS

The benefits of a deactivation hydraulic valve lifter improved in accordance with the invention may be better appreciated by first considering the features of a prior art deactivating lifter.

Figure 1:
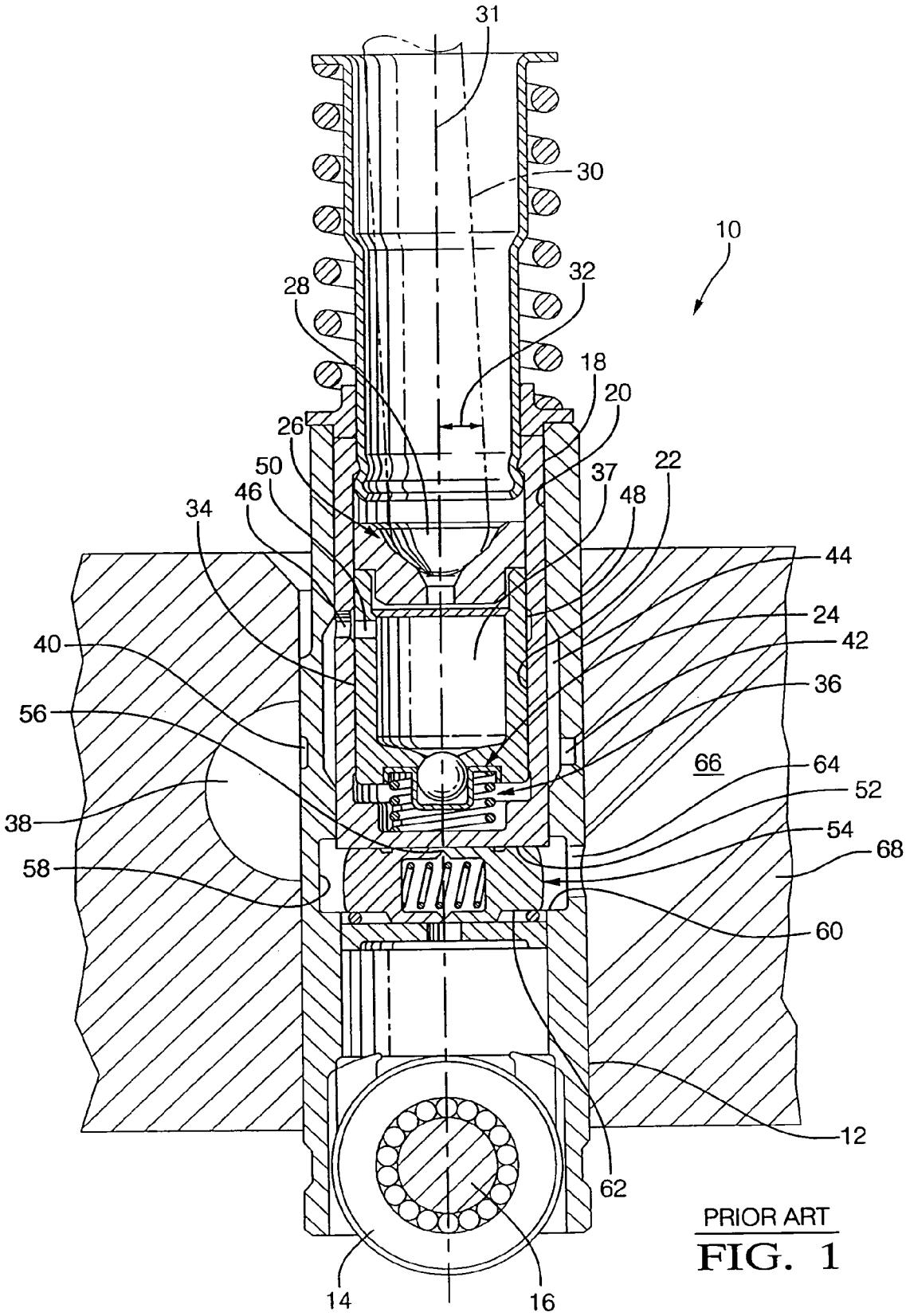
PRIOR ART FIG. 1
FIG. 1 is an elevational cross-sectional view of a prior art deactivation hydraulic valve lifter, shown mounted in an internal combustion engine.

Referring to FIG. 1, a valve-deactivating hydraulic valve lifter 10 has a generally cylindrical lifter body 12 supporting conventionally at a lower end a cam follower means such as roller 14 rotatably attached to body 12 by an axle 16 for following a cam lobe (not shown). A pin housing 18 is slidably disposed within a first axial bore 20 in lifter body 12. Pin housing 18 itself has a second axial bore 22 for receiving a conventional hydraulic lash adjuster (HLA) mechanism generally designated 24. HLA 24 includes a pushrod seat 26 for receiving a ball end 28 of a conventional engine valve pushrod 30. Lifter 10 is especially useful in accommodating engine designs wherein the pushrod is not coaxially disposed with lifter axis 31 but rather forms an included angle 32 therewith, for example, 7.5°. HLA 24 further includes a plunger element 34 slidably disposed within bore 22 and supported by a check valve sub-assembly 36 for urging plunger element 34 and seat 26 towards pushrod 30 to eliminate mechanical lash in the valve train. Plunger element 34 contains a chamber 37 in communication with engine oil gallery 38 via a first annular groove 40 in the outer surface of lifter body 12, a first oil supply port 42 between groove 40 and a second annular groove 44 in bore 20, a second oil supply port 46 in the wall of pin housing 18 between groove 44 and a third annular groove 48 in bore 22, and a third oil supply port 50 in the wall of plunger element 34 between groove 48 and chamber 37.

Pin housing 18 has a transverse bore 52 slidably receivable of two opposed locking pins 54 separated by a pin-locking spring 56 disposed in compression therebetween. First axial bore 20 in lifter body 12 is provided with a circumferential groove 58 for receiving the outer ends of locking pins 54, thrust outwards by spring 56 when pins 54 are axially aligned with groove 58. Groove 58 includes an axial surface 60 defining a locking surface for receiving an axial face 62 on pins 54. Groove 58 further defines a reservoir for providing high pressure oil against the outer ends of locking pins 54 to overcome spring 56 and retract the locking pins into bore 52, thereby unlocking the pin housing from the lifter body to deactivate the lifter. Groove 58 is in communication via at least one port 64 with an oil gallery 66 in engine 68, which in turn is supplied with high pressure oil by an engine control module (not shown) under predetermined engine parameters in which deactivation of valves is desired.

Figure 2A:
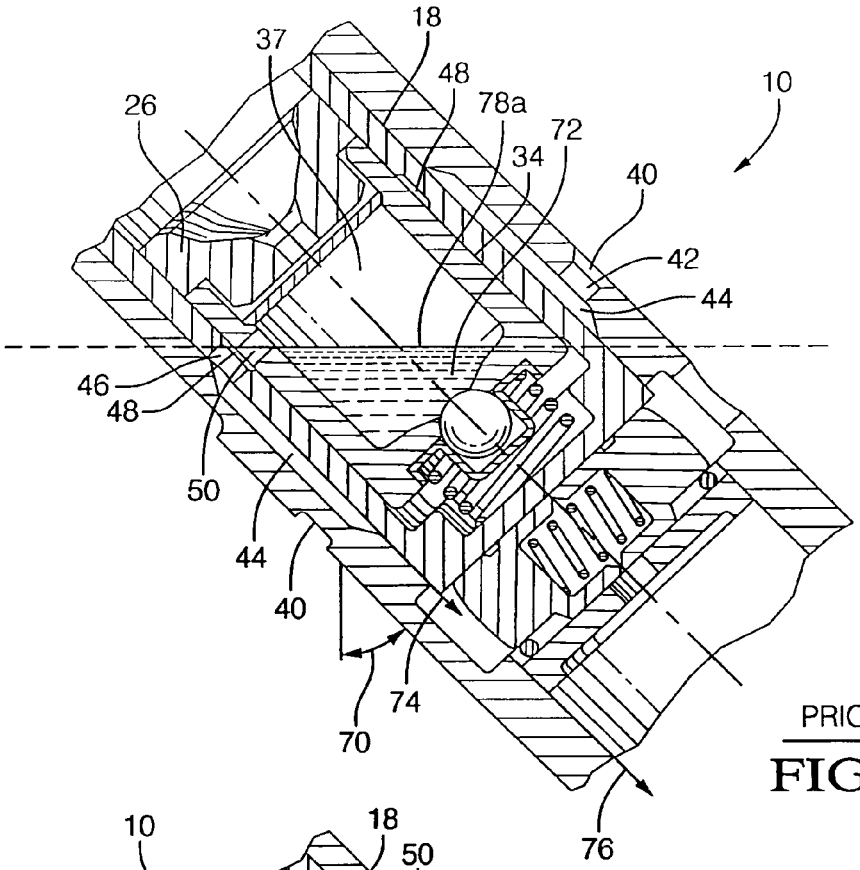
PRIOR ART FIG. 2 a
FIG. 2*a* is an elevational cross-sectional view of the prior art lifter shown in FIG. 1, showing the potential for drainage of oil when the lifter is mounted in a V-style or slant mount engine.

Referring to FIG. 2*a*, a problem inherent in use of prior art lifter 10 when tipped at approximately 45° is illustrated. Lifter 10 incorporates no means for preventing free rotation of plunger element 34 within pin housing 18, nor of pin housing 18 within lifter body 12. However, in V-style engines and in slant mounted inline engines, lifter 10 is oriented at an angle 70 from vertical, for example, 45°. As the plunger and pin housing are free to rotate, when the engine is shut off sometimes the plunger and pin housing will come to rest having their oil supply ports 46,50 oriented downwards, on the "underside" of these elements. The mechanical tolerances between the pin housing and the lifter body are such that, over time, oil 72 can leak 74,76 from chamber 37, being replaced by air from above the lifter through seat 26, until the oil level 78*a* within chamber 37 reaches the lip of oil supply port 50. As noted above, this can cause noisy engine operation for a period of time after the engine is restarted, before the plunger element can be refilled by engine oil. Such noisy operation is obviously highly undesirable and can lead to premature wear of engine components.

Figure 2B:
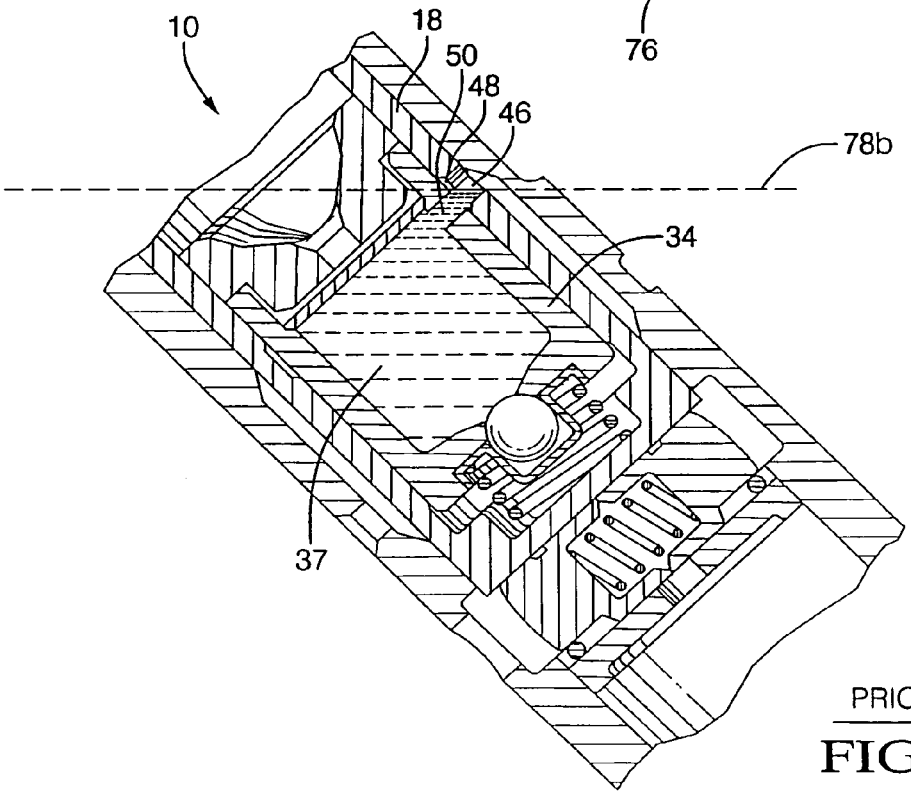
PRIOR ART FIG. 2 b
FIG. 2*b* is an elevational cross-sectional view similar to that shown in FIG. 2*a*, showing the desired orientation of the lifter pin housing to prevent drainage of oil when the lifter is mounted in a V-style or slant mount engine.

Referring to FIG. 2*b*, the most desirable orientation of plunger element 34 and pin housing 18 is shown, wherein both oil supply ports 46,50 are oriented upwards such that the resting oil level 78*b* is controlled by the lip of supply port 50, and chamber 37 remains full and hydraulically rigid. The present invention is directed to means for preventing rotation between pin housing 18 and lifter body 12 and for preferably orienting supply port 50 upwards as shown in FIG. 2*b*.

Figure 3:
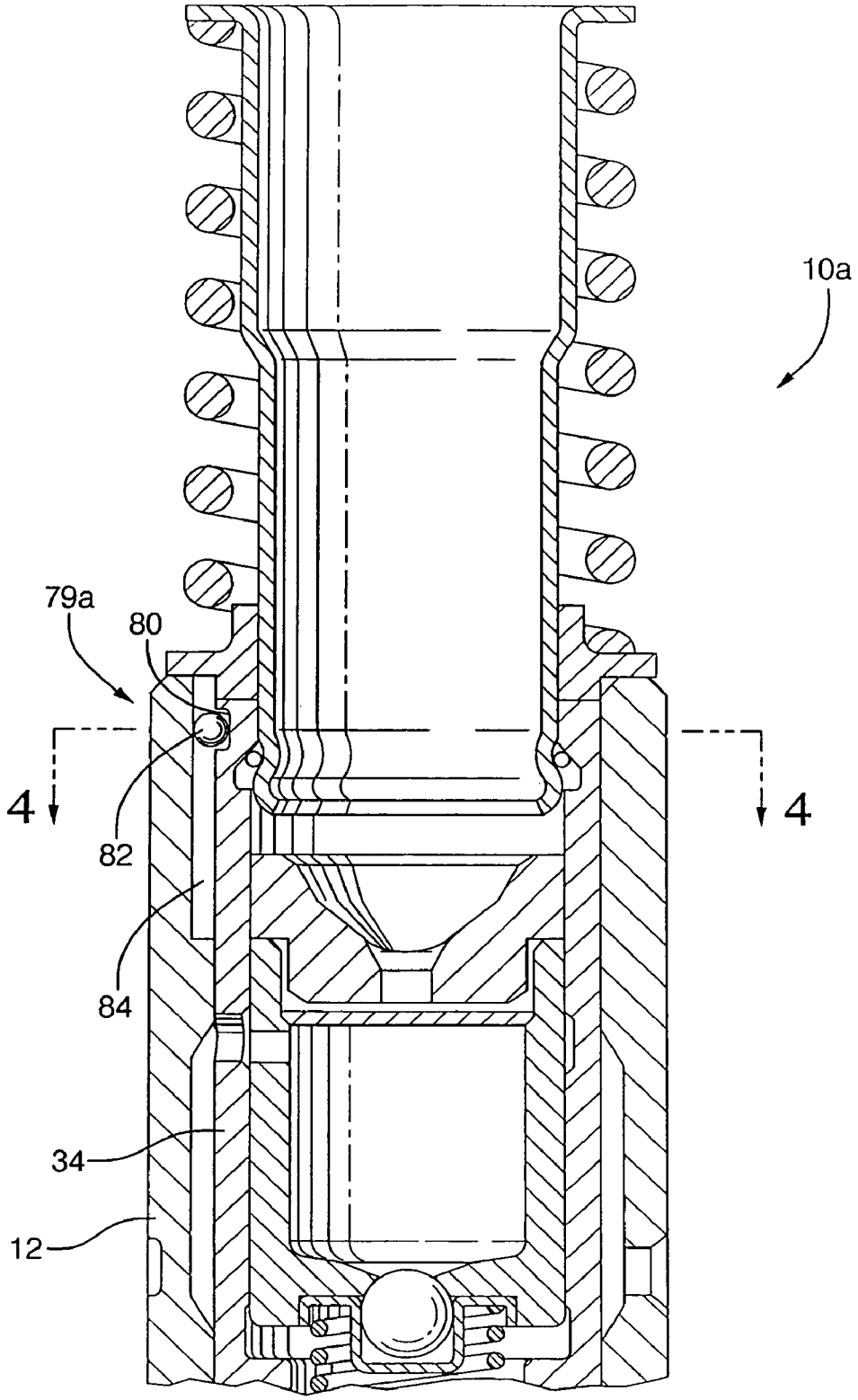
FIG. 3 is an elevational cross-sectional view of a first embodiment of an improved lifter in accordance with the invention.
Figure 4:
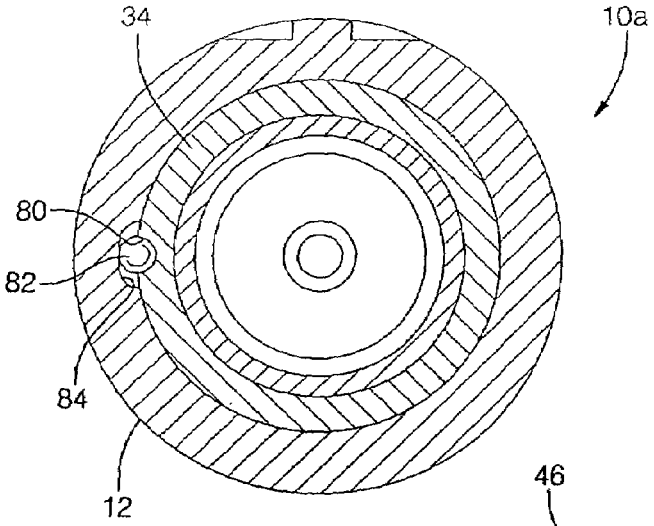
FIG. 4 is a cross-sectional view taken along line 4—4 in FIG. 3.

Referring to FIGS. 3 and 4, a first embodiment 10*a* of an improved valve deactivation lifter in accordance with the invention may be structurally identical with prior art lifter 10, except for inclusion of a clocking mechanism 79*a* to maintain a predetermined orientation of the pin housing to the lifter body and to limit rotation therebetween. Pin housing 18 is provided with a recess 80 on the outer surface thereof, for example, a hemispherical dimple or a drill point, for receiving a locking element 82, preferably a ball. Lifter body 12 is provided with a longitudinal channel 84, preferably hemicylindrical, for complementarily receiving locking element 82. Thus, the pin housing and the lifter body are free to slide axially of each other, as is necessary during valve deactivation mode, while rotation with respect to each other is limited. By properly selecting the rotational location of the recess and channel, the optimal relationship of oil supply port 46, as shown in FIG. 2*b*, can be assured. Note that the orientation of plunger oil supply port 50 is irrelevant because the well in pin housing 34 in which the plunger and HLA sub-assembly are disposed is closed at the bottom. Also note that, within the scope of the invention, the recess may be provided in the lifter body and the channel in the pin housing, to equal effect. Further note that, by selecting the width of channel 84 relative to the width of locking element 82, the relative rotation permitted between pin housing 18 and body 12 can be controlled from approximately zero degrees to many degrees.

Figure 5:
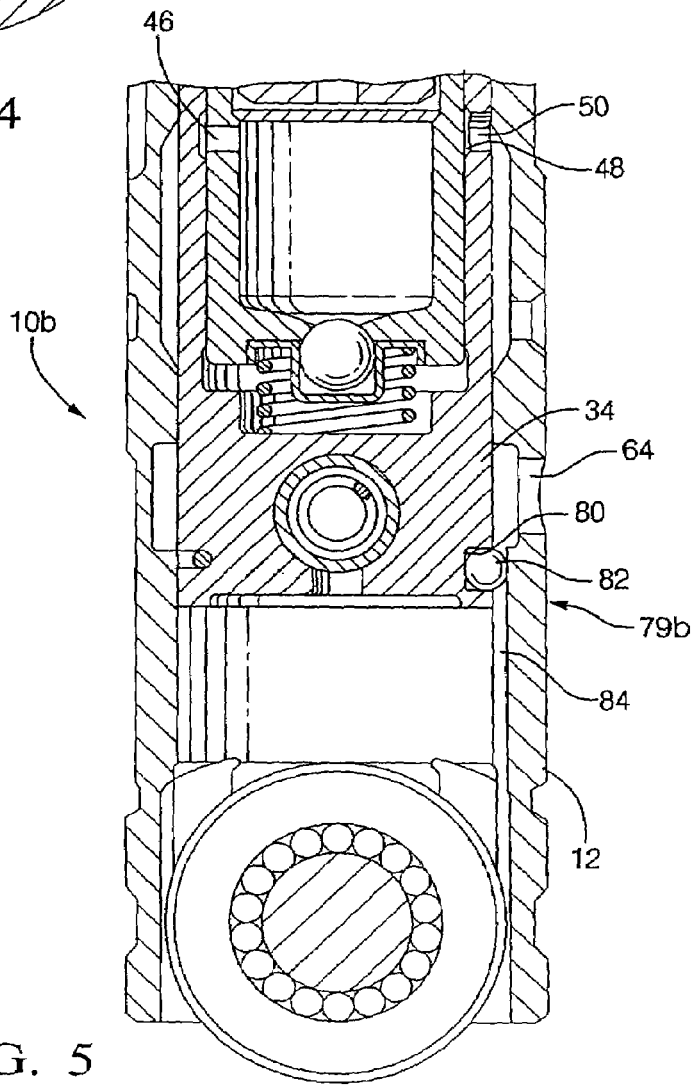
FIG. 5 is an elevational cross-sectional view of a second embodiment of an improved lifter.

Referring to FIG. 5, a second embodiment 10*b* is similar to first embodiment 10*a* in that clocking mechanism 79*b* also employs a locking element 82, preferably a ball, disposed in a recess 80 on the periphery of pin housing 34. Lifter body 12 is provided with a longitudinal channel 84, preferably hemicylindrical, for complementarily receiving locking element 82. In this embodiment, the locking element is disposed near the lower end of the overlap between the pin housing and the lifter body. The locking element is easily inserted into the recess and slot via oil deactivation port 64 during assembly of the lifter. Note that the locking element must fit snugly in both the recess and the channel to minimize oil leakage bypassing the locking pin mechanism during deactivation. Also note that the relative rotation permitted between the pin housing and body can be controlled by sizing the width of either channel 84 or recess 80.

Figure 6:
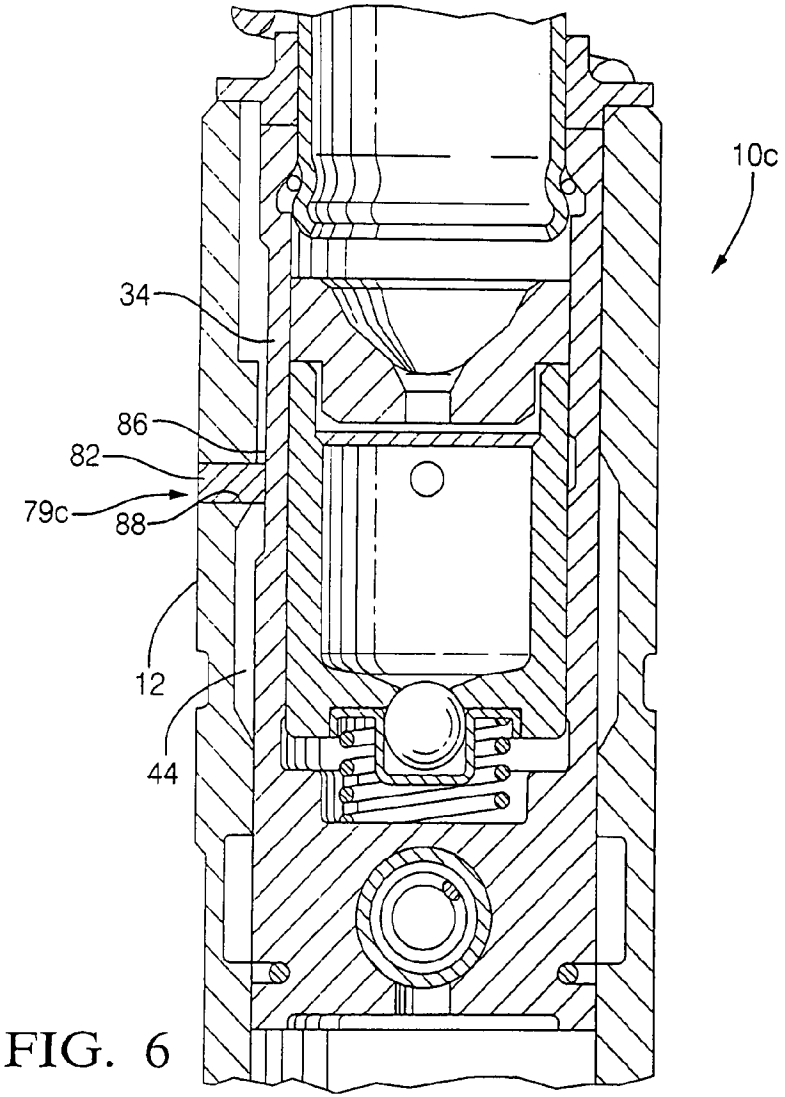
FIG. 6 is an elevational cross-sectional view of a third embodiment of an improved lifter.

Referring to FIG. 6, a third embodiment 10*c* may also be structurally identical with prior art lifter 10 except for clocking mechanism 79*c*. An axially-extending flat 86 is provided on the otherwise cylindrical outer surface of pin housing 34. An additional port 88 extends through the wall of lifter body 12 and receives a pressed-in locking element 82, preferably a snug-fitting pin, the inner end of which rides on flat 86 at a reduced diameter of pin housing 34 and thus prevents the pin housing from rotating past the pin and the lifter body. Relative axial motion is unimpeded. Because flat 86 intersects annular oil supply chamber 44 and port 88 enters that chamber, it is important that pin 82 be snugly inserted in port 88 to prevent leakage to the outside of lifter body 12.

Figure 7:
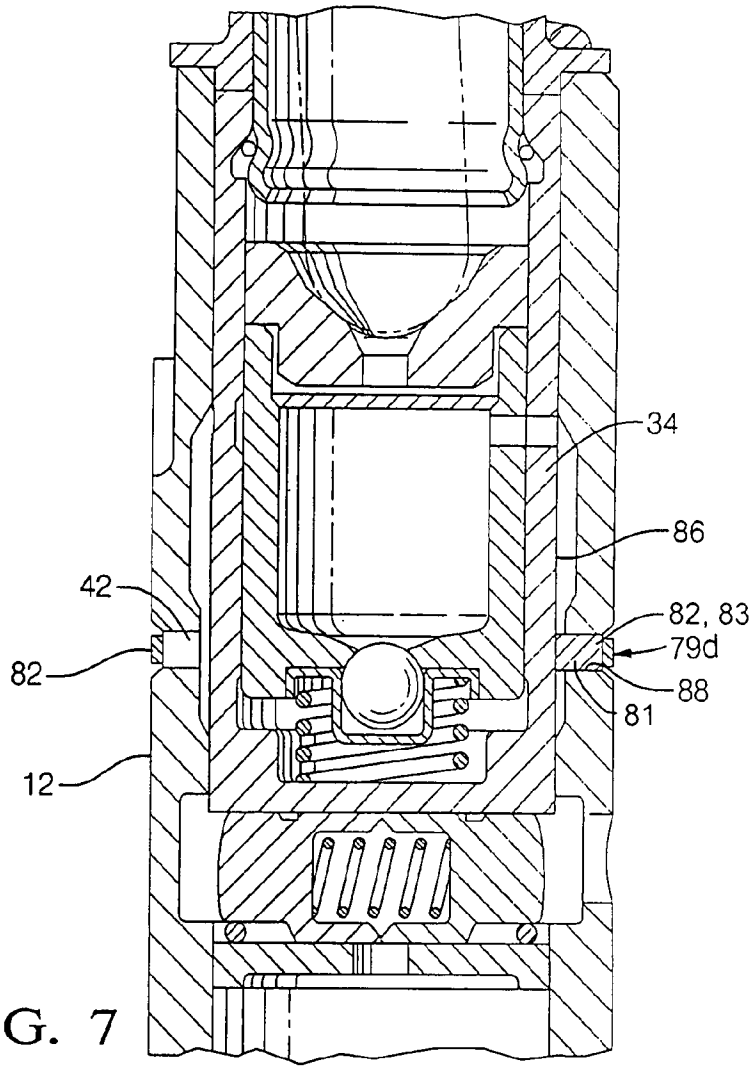
FIG. 7 is an elevational cross-sectional view of a fourth embodiment of an improved lifter.

Referring to FIG. 7, a fourth embodiment 10*d* may also be structurally identical with prior art lifter 10 except for clocking mechanism 79*d*. An axially-extending flat 86 is provided on the otherwise cylindrical outer surface of pin housing 34 in the axial region of oil supply port 42 extending through lifter body 12. An additional port 88 extends through the wall of lifter body 12 and receives a locking element 82, preferably a circular spring clip 83 having at least one inwardly-extending tang which rides on flat 86 at a reduced diameter of pin housing 34 and thus prevents the pin housing from rotating past pin 82 and lifter body 12. Relative axial motion is unimpeded. Oil flows around tang 81 when entering port 42.

While the most desirable orientation of pin housing 18, shown in FIG. 2*b*, positions oil supply port 50 at the upwards most position, it is understood that benefits of the present invention can be realized with oil supply port 50 being oriented upward in any position above horizontal (in the range of +/−90° from the position shown in FIG. 2*b*).

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A valve-deactivating hydraulic lifter for selectively coupling the rotary motion of a cam lobe to the reciprocal motion of a valve pushrod in an internal combustion engine, wherein oil is retained in the lifter during periods of engine shutdown, comprising:

a) a lifter body having means for following an eccentric surface of said cam lobe and having a first axial bore and having an annular groove formed in a wall of said first axial bore, said groove being in communication with an oil gallery in said engine;

b) a pin housing slidably disposed in said first axial bore and having a transverse bore;

c) a pair of opposed locking pins slidably disposed in said transverse bore and each having an outer end for selectively engaging said groove to lock said pin housing to said lifter body;

d) a clocking mechanism for limiting relative rotation between said pin housing and said lifter body; and e) a hydraulic lash adjustment mechanism disposed in a second axial bore of said pin housing, wherein said hydraulic lash adjustment mechanism includes a chamber for holding oil, and wherein said pin housing includes an oil supply port in communication with said chamber, and wherein said clocking mechanism causes said oil supply port to be positioned on the top side of said pin housing when said lifter is installed in said internal combustion engine at an angle greater than zero degrees from vertical.

2. A valve lifter in accordance with claim 1, further including a seat for receiving an end of said pushrod.

3. A valve lifter in accordance with claim 1 wherein said clocking mechanism comprises:

a) a recess formed in one of said pin housing and said lifter body;

b) a longitudinal channel formed in the other of said pin housing and said lifter body; and c) a locking element disposed in said recess and said channel and extending therebetween.

4. A valve lifter in accordance with claim 3 wherein said locking element is a ball.

5. A valve lifter in accordance with claim 1 wherein said clocking mechanism comprises:

a) a flat formed on an outer surface of said pin housing;

b) a port formed through a wall of said lifter body; and c) a locking element disposed in said port and extending into contact with said flat.

6. A valve lifter in accordance with claim 5 wherein said locking element is selected from the group consisting of a pin and a spring clip.

7. An internal combustion engine comprising a valve-deactivating hydraulic lifter installed in said engine for selectively coupling the rotary motion of a cam lobe to the reciprocal motion of a valve pushrod, wherein oil is retained in the lifter during periods of engine shutdown, the lifter including a lifter body having means for following an eccentric surface of said cam lobe and having a first axial bore and having an annular groove formed in a wall of said first axial bore, said groove being in communication with an oil gallery in said engine, a pin housing slidably disposed in said first axial bore and having a transverse bore, a pair of opposed locking pins slidably disposed in said transverse bore and each having an outer end for selectively engaging said groove to lock said pin housing to said lifter body, a clocking mechanism for limiting relative rotation between said pin housing and said lifter body, and a hydraulic lash adjustment mechanism disposed in a second axial bore of said pin housing, wherein said hydraulic lash adjustment mechanism includes a chamber for holding oil, and wherein said pin housing includes an oil supply port in communication with said chamber, and wherein said clocking mechanism causes said oil supply port to be positioned on the top side of said pin housing when said lifter is installed in said internal combustion engine at an angle greater than zero degrees from vertical.

8. An engine in accordance with claim 7 wherein said lifter further includes a seat for receiving an end of said pushrod.

9. An engine in accordance with claim 8 wherein said engine is a slant mount engine.

10. An engine in accordance with claim 8 wherein said engine is a V-style engine.

11. A valve-deactivating hydraulic lifter for selectively coupling the rotary motion of a cam lobe to the reciprocal motion of a valve pushrod in an internal combustion engine, wherein oil is retained in the lifter during periods of engine shutdown, comprising:

a) a lifter body having means for following an eccentric surface of said cam lobe and having a first axial bore and having an annular groove formed in a wall of said first axial bore, said groove being in communication with an oil gallery in said engine;

b) a pin housing slidably disposed in said first axial bore and having a transverse bore;

c) a pair of opposed locking pins slidably disposed in said transverse bore and each having an outer end for selectively engaging said groove to lock said pin housing to said lifter body; and d) a clocking mechanism for limiting relative rotation between said pin housing and said lifter body, wherein said clocking mechanism comprises:

a recess formed in one of said pin housing and said lifter body;

a longitudinal channel formed in the other of said pin housing and said lifter body; and a locking element disposed in said recess and said channel and extending therebetween, wherein said locking element is a ball.

12. A valve-deactivating hydraulic lifter for selectively coupling the rotary motion of a cam lobe to the reciprocal motion of a valve pushrod in an internal combustion engine, wherein oil is retained in the lifter during periods of engine shutdown, comprising:

a) a lifter body having means for following an eccentric surface of said cam lobe and having a first axial bore and having an annular groove formed in a wall of said first axial bore, said groove being in communication with an oil gallery in said engine;

b) a pin housing slidably disposed in said first axial bore and having a transverse bore;

c) a pair of opposed locking pins slidably disposed in said transverse bore and each having an outer end for selectively engaging said groove to lock said pin housing to said lifter body; and d) a clocking mechanism for limiting relative rotation between said pin housing and said lifter body, wherein said clocking mechanism comprises:

a flat formed on an outer surface of said pin housing;

a port formed through a wall of said lifter body; and a locking element disposed in said port and extending into contact with said flat, wherein said locking element is a spring clip.

* * * * *